United States Patent [19]

Buanno

[11] 4,008,706

[45] Feb. 22, 1977

[54] FIREPLACE FURNACE

[76] Inventor: John M. Buanno, Paradise Point Road, Mayfield, N.Y. 12117

[22] Filed: June 27, 1975

[21] Appl. No.: 590,861

[52] U.S. Cl. ..... 126/121; 126/164

[51] Int. Cl.[2] ..... F24B 7/02

[58] Field of Search ..... 126/121, 122, 143, 164, 126/165, 131, 99 C, 99 D, 118; 237/51

[56] References Cited

UNITED STATES PATENTS

| | | | |
|---|---|---|---|
| 438,274 | 10/1890 | Miller | 126/121 |
| 2,375,318 | 5/1945 | Mudgett | 126/121 |
| 3,190,282 | 6/1965 | Bauer | 126/121 X |
| 3,452,737 | 7/1969 | Pellegrino et al. | 126/121 |

FOREIGN PATENTS OR APPLICATIONS

| | | | |
|---|---|---|---|
| 136,452 | 2/1950 | Australia | 126/121 |
| 74,394 | 12/1948 | Norway | 126/121 |
| 783,521 | 9/1957 | United Kingdom | 126/118 |
| 520,860 | 5/1940 | United Kingdom | 126/121 |
| 556,543 | 10/1943 | United Kingdom | |
| 749,073 | 5/1956 | United Kingdom | 126/121 |

*Primary Examiner*—William F. O'Dea
*Assistant Examiner*—Harold Joyce
*Attorney, Agent, or Firm*—Clarence A. O'Brien; Harvey B. Jacobson

[57] ABSTRACT

A fireplace furnace having an enclosed housing provided with an inlet and an outlet, the inlet and outlet being spaced from one another on the housing and arrangeable in the front portion of an opening of a fireplace in which the furnace is disposed. Baffles, including a plurality of arcuate planar members, are arranged within the housing for deflecting air flowing from the inlet of the housing to the outlet thereof along a tortuous path within the housing. The top wall of the housing may be provided with undulations which increase the heat transfer surface of the furnace, as well as provide a grate for burning a conventional solid fuel in the fireplace directly on top of the furnace.

9 Claims, 4 Drawing Figures

FIREPLACE FURNACE

BACKGROUND OF THE INVENTION

1. Field of the Invention

This invention relates generally to a heat extracting device for use with fireplaces, stoves, furnaces, and the like, and particularly to a fireplace furnace which may be placed into an existing fireplace and function as a grate for fuel being burned in the fireplace as well as increase the heat transfer efficiency of the fireplace.

2. Description of the Prior Art

It is generally known to provide heat exchange devices to be used in conjunction with fireplaces, stoves, furnaces, and similar heating devices to increase the heat transfer efficiency of the heating device by facilitating heat conduction and heat convection mechanisms by which heat is transferred from the fireplace or other heating device into the room or other area or article being heated. The conduction of heat is the primary transfer mechanism from a fire to the surface of a fireplace furnace, although heat is also obtained by radiation. To a somewhat lesser degree, internal, or heat chamber, convection from a fireplace furnace is of prime importance, with radiation again providing some heat.

Considering the heating of the surface of a fireplace furnace, heat transfer by conduction is depended on three factors: (1) temperature within; (2) surface area of the furnace; and (3) the material from which the furnace is constructed. The temperature within the furnace is depended on the fuel being employed, and may be considered constant for any given system while the material selected for use in constructing the furnace is based on structural stresses resulting from the intense heat generated from fuel burned. Thus, surface area is the parameter most easily improved on in order to increase efficiency of a fireplace furnace.

It is generally known to provide fireplace furnaces in the form of grates constructed from at least one tubular member attached to other structural members, or other tubes, to form a grate-like framework. Examples of such fireplace grates may be found in U.S. Pat. Nos. 418,215, issued Dec. 31, 1889 to W. L. Nason, 2,702,030, issued Feb. 15, 1955 to O. B. Leibst, 3,001,521, issued Sept. 26, 1961 to A. L. Reilly, and 3,240,206, issued Mar. 15, 1966 to K. M. Schutt. U.S. Pat. No. 2,828,070, issued Mar. 25, 1958 to H. C. Snodgrass, discloses a hearth heater similar to the aforementioned prior art devices, but not specifically intended to function as a grate, while U.S. Pat. No. 2,375,318, issued May 8, 1945 to E. L. Mudgett discloses a draft device in the form of a box-like container having a planar top which forms a grate provided with a series of passageways receiving air from beneath the fireplace, with the device covering substantially the entire hearth of the fireplace. The latter mentioned device, however, must be used in conjunction with specially constructed fireplaces as must the fireplace and grate disclosed in U.S. Pat. No. 418,215, and the fireplace heater disclosed in U.S. Pat. No. 2,702,030.

Thus, it can be readily appreciated that fireplaces, although, used extensively are very inefficient. Accordingly, it has long been known to employ various kinds of fireplace furnaces in order to increase the efficiency of fireplaces, but the success of the prior art fireplace furnaces has generally not been sufficient to encourage their wide spread use.

SUMMARY OF THE INVENTION

It is an object of the present invention to provide additional heat into a location where it may be usefully used.

It is another object of the present invention to provide a fireplace furnace having increased portability when compared to known furnaces.

It is still another object of the present invention to provide a fireplace furnace shaped to enhance the proper operation of a fireplace in which the furnace is installed and to provide the most efficient operation possible for a particular application and further not to detract or deteriorate the aesthetics of a home or other location in which the fireplace is disposed.

It is a still further object of the present invention to provide a fireplace furnace wherein air is forced through the heat chamber of the furnace, to release the chamber of this heat, and to transfer the heat into a room or other area or distribution system associated with the fireplace.

It is yet another object of the present invention to provide a fireplace furnace having a surface forming a grate on which fuel such as wood, paper, coal, and the like may be burned, which surface is sufficiently rigid to support the fuel and which is sufficiently effective as a heat conductor to obtain heat for direct and/or indirect heat absorption into the heat chamber of the furnace.

It is another object of the present invention to provide a heat extracting device which requires no modifications to an existing fireplace installation.

A further object of the present invention is to provide a heat extracting device which may be used on a new fireplace installation, or continue to be used even if modifications are made to the existing fireplace.

These and other objects are achieved according to the present invention by providing a fireplace furnace having: an enclosed housing including an inlet and an outlet, the inlet and outlet preferably spaced from one another on a wall common to the inlet and outlet, with the common wall being arrangeable in the opening of a conventional fireplace so as to be foremost in the opening: and one or more baffles arranged within the housing for defecting air flowing from the inlet to the outlet of the housing along a tortuous path within the housing.

Preferably, the housing is substantially rectangular and has substantially planar walls, with the inlet and outlet being provided in a front rectangular wall of the housing, the inlet and outlet being spaced along the longitudinal extent of the rectangular front wall.

Among the baffles are advantageously included a pair of spaced, substantially parallel, planar plates disposed extending into the housing from the common wall toward, but spaced from, a wall parallel to the common wall, the plates being adjacent to, but disposed between the inlet and outlet of the common wall and extending from a bottom wall of the housing to a top wall thereof.

The baffles also advantageously include a plurality of arcuate members disposed extending between the top wall and the bottom wall of the housing. Where arcuate members are provided, two of the arcuate members, which may be castings, curved plates, and the like, are arranged substantially co-planar, but spaced, opposite of and opening concavely toward ones of the inlet and outlet of the housing, while the third arcuate member is arranged between the aforementioned baffle plates and between, but spaced from, the aforementioned two of the arcuate members, and opens concavely toward the two of the arcuate members so as to form in cooperation with the two of the arcuate members a series of concave baffles forming a zig-zag flow path.

A plurality of longitudinal braces preferably are mounted within the housing. One of the braces is advantageously disposed between a side wall of the housing and the baffle plate associated with one of the inlet and outlets, while braces are also advantageously disposed between the top wall and bottom wall of the housing along the flow path formed by the arcuate members in order to rigidify the housing and increase the heat transfer area of the furnace. Further, heat transfer fins may be provided on the braces for still further increasing the heat transfer area of the furnace.

A particularly advantageous feature of the present invention is the provision of undulations in the top wall of the housing. These undulations are preferably arranged traverse to the common wall, or front wall, and back wall of the housing for providing additional heat transfer surface to the housing and forming a grate for holding a fuel, such as wood, coal, paper, and the like being burned in the fireplace in which the fireplace furnace is disposed.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
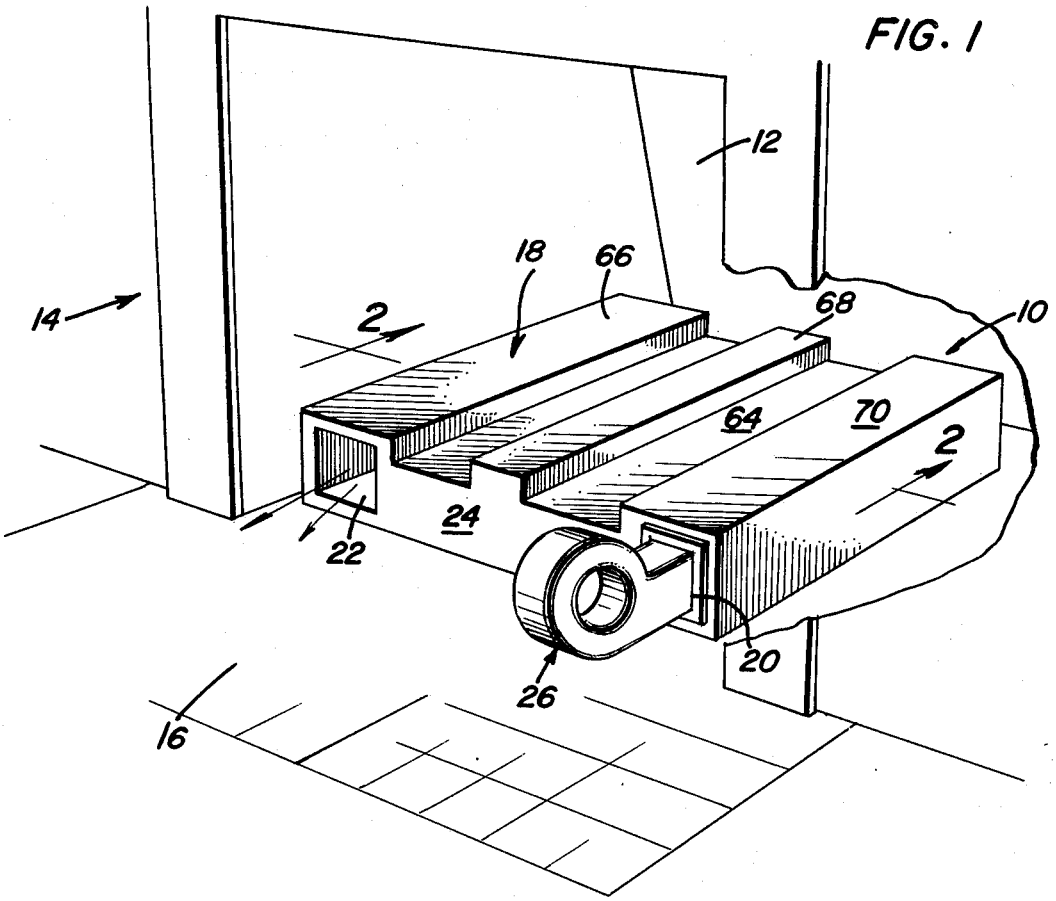
FIG. 1 is a schematic, perspective view, partly broken away, showing a fireplace furnace according to the present invention disposed in a conventional fireplace.

Referring now more particularly to FIG. 1 of the drawings, a fireplace furnace 10 according to the present invention is shown placed in opening 12 of a conventional fireplace 14 provided with a hearth 16. As will become more apparent further on, furnace 10 is formed by a housing 18 which simply rests on the hearth 16 of a fireplace 14. The aforementioned housing 18 is provided with an inlet opening 20, an outlet opening 22 in a wall 24 common to both inlet 20 and outlet 22. As can be readily appreciated from FIG. 1, wall 24 is effectively the front wall of housing 18 as the latter is disposed in an opening 12 of a fireplace 14.

A conventional blower 26 is advantageously mounted in inlet 20 of housing 18 for forcing air in a known manner along a flow path through housing 18 as is to be described below. Further, although not specifically shown in FIG. 1, or any of the other drawings, it is also possible to connect outlet 22 to an air distribution duct so as to force heated air from housing 18 throughout an entire home or similar structure being heated.

Figure 2:
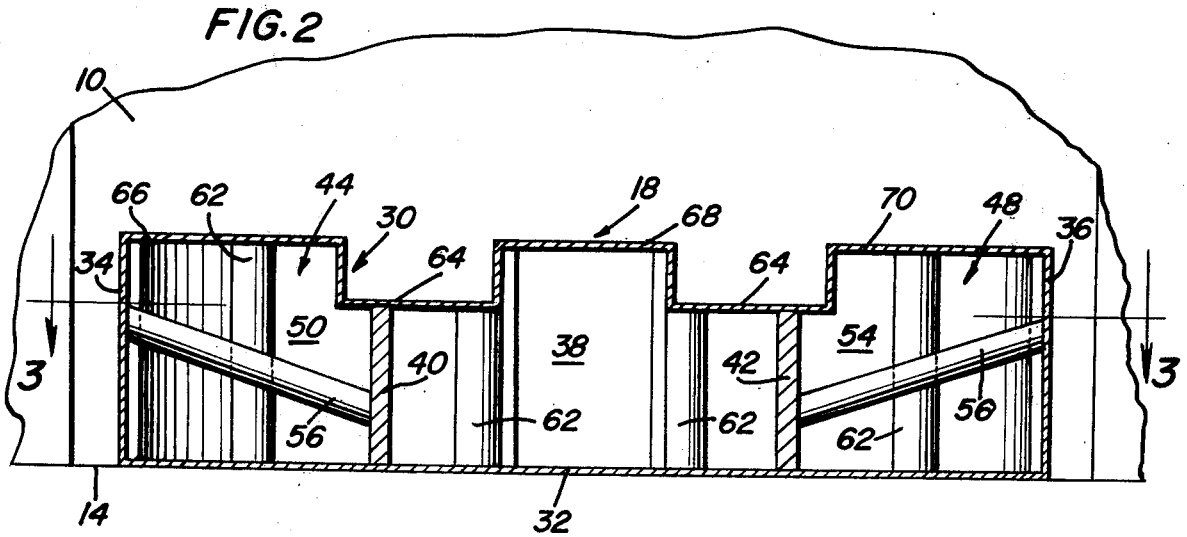
FIG. 2 is a sectional view taken generally along the line 2—2 of FIG. 1, but drawn to a larger scale.
Figure 3:
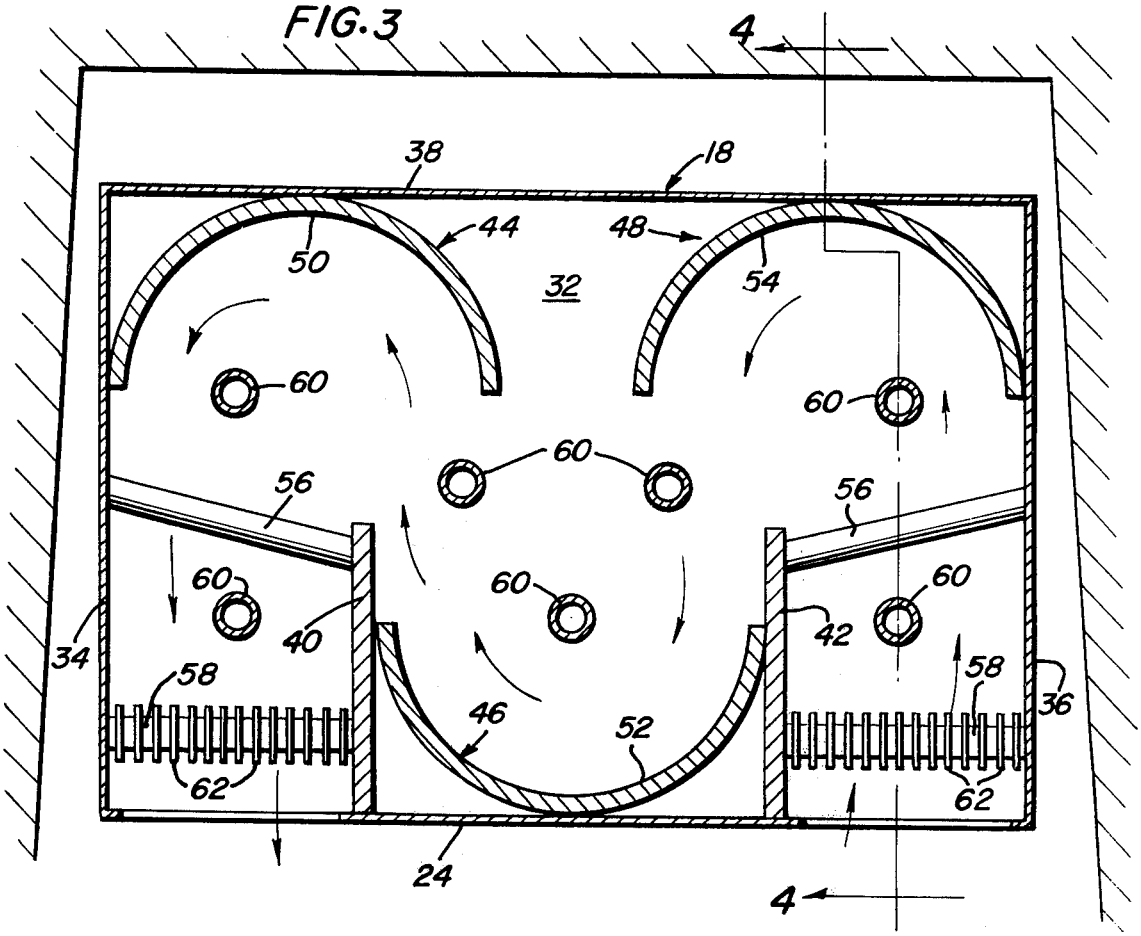
FIG. 3 is a sectional view taken generally along the line 3—3 of FIG. 2.
Figure 4:
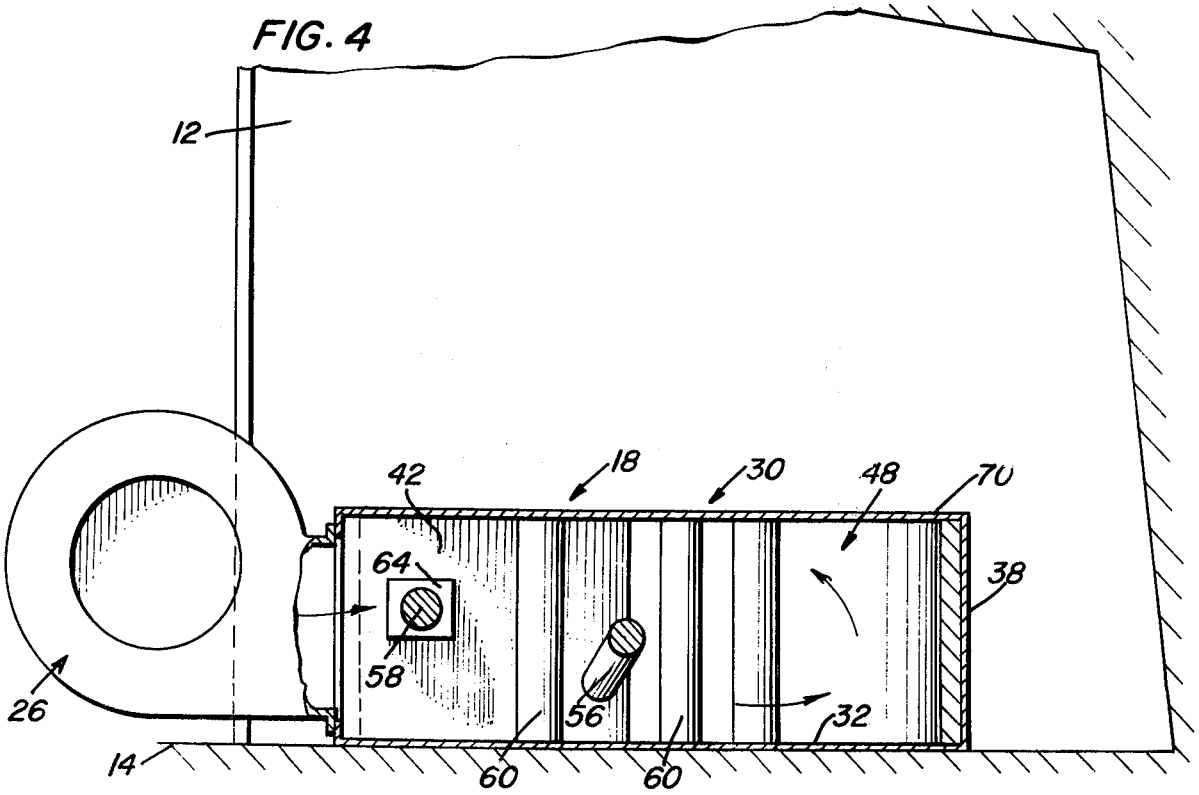
FIG. 4 is a sectional view taken generally along the line 4—4 of FIG. 3.

Referring now more particularly to FIGS. 2–4 of the drawings, housing 18 is advantageously the illustrated substantially rectangular box-like structure having substantially planar walls meeting one another at substantially right angles. Thus, inlet 20 and outlet 22 can be provided in the front rectangular wall 24 of housing 18, as shown, with inlet 20 and outlet 22 being spaced transversely along the longitudinal extent of the rectangular common wall 24. Further housing 18 is formed by a top wall 30, the configuration of which will be described below, a substantially planar bottom wall 32, the substantially parallel and planar side walls 34 and 36, and a substantially planar wall 38 arranged substantially parallel to front wall 24. Inlet 20 and outlet 22 could also be disposed in side walls 34, 36 in a manner not shown. As will be appreciated from the drawings, all of the aforementioned walls with the exception of top wall 30 are substantially planar, and may be thought of as panels. It is to be understood that the outer casing of housing 18, that formed by the aforementioned walls, may be of any desirable thickness, and may vary from the proportional thickness illustrated in the drawings. Further, the aforementioned walls forming housing 18 may be constructed from any suitable, known material, although a material such as iron having good heat transmitting and storage characteristics, as well as good structural strength, is preferable.

As now will be discussed, housing 18 includes one or more baffles arranged within the housing for deflecting air flow, designated by the flow arrows in the drawings, from inlet 20 to outlet 22 along a tortuous path within housing 18.

The aforementioned baffles advantageously include a pair of spaced, substantially parallel, plates 40 and 42 disposed extending into housing 18 from the common, or front, wall 24 toward the spaced from, back wall 38. Plates 40 and 42 are also adjacent to, but disposed between, the inlet 20 and the outlet 22, and extend from bottom wall 32 to top wall 30 of housing 18. In this manner, plates 40 and 42 form air flow passageways within housing 18 that extend from front wall 24 part of the way toward back wall 38. As illustrated, the plates 40 and 42 extend substantially half way between front wall 24 and back wall 38.

The baffles advantageously further include a plurality, of arcuate members, with three arcuate members 44, 46 and 48 being illustrated. These arcuate members 44, 46 and 48 are disposed extending between top wall 30 and bottom wall 32 of housing 18. Two of the arcuate members 44 and 48 each are arranged lying in a common vertical plane of finite thickness, in spaced relation, opposite of and opening concavely toward respective ones of inlet 20 and outlet 22. The third arcuate member 46 is arranged between plates 40 and 42, and between the spaced arcuate members 44 and 48 and itself spaced from the latter two members, and opening concavely toward arcuate members 44 and 48 in order to form the essentially zig-zag flow path as best seen in FIG. 3. Each of the arcuate members 44, 46 and 48 thus forms a concave surface 50, 52 and 54, respectively which acts as a substantially 180 degree deflector for air moving along the associated flow path of housing 18.

While the plates and three arcuate members have been shown and described as forming a four-pass heat exchange system, it is to be understood that plates and arcuate members can be used in various combinations to form two-pass, six-pass and other systems as desired.

A plurality of longitudinally extending braces 56, 58 and 60 are shown as mounted within housing 18. Braces 56 and 58 are mounted between the associated side walls 34 and 36 of housing 18 and the plates 40 and 42 associated with the side wall and the respective one of the inlet 20 and outlet 22. Braces 60 are disposed between top wall 30 and bottom wall 32 of housing 18 along the flow path formed by the arcuate members 44, 46 and 48, for rigidifying housing 18 and increasing the heat transfer and storage capacity of furnace 10. Of course, the number of braces used can vary as circumstances warrant.

To further increase the heat transfer capabilities of furnace 10, the braces may be provided with fins 62, which may be in the form of the illustrated apertured plates, or at least selected ones of the aforementioned braces. As illustrated, fins 62 are arranged in parallel fashion on braces 58. As can be readily seen from the drawings, braces 56, 58 and 60 are preferably in the form of solid rods constructed from a suitable, known material.

Top wall 30 preferably has undulations transverse to walls 24 and 38 for providing additional heat transfer surface and forming a grate for holding a fuel (not shown), such as coal, wood, paper, and the like, being burned in fireplace 10. These undulations may form the illustrated recesses 64 intermediate ridges 66, 68, and 70.

As will be appreciated from the above description and from the drawings. A fireplace furnace according to the present invention can be accommodated in conventional fireplaces as well as in certain stoves, furnaces, and the like, as they exist today simply by inserting the furnace into, or partially into the firebox area of the associated fire containing structure. Applicant has conducted tests in an existing fireplace, and the invention displays exceptional results. In order to provide a fireplace furnace suitable to all styles and designs of fireplaces, however, it may be necessary to vary the external design of the fireplace furnace to varying degrees. Further, it will be appreciated from, for example, FIG. 1 of the drawings, recesses 64 will also received the longitudinally extending portion of conventional andirons (not shown) if so desired to enhance the aesthetic appeal of the fireplace.

Once in the heat chamber of a fireplace furnace according to the present invention, heat is conducted throughout same via the heat transfer elements, structural elements, wall, panels, air directing veins and partitions. Air forced through the heat chamber by means of an electrically driven fan or blower, such as designated 26 in FIG. 1 of the drawings, passes over all such heat components of the furnace. Thus, heat transfer is much more complex in this situation; but, basically the additional heat transfer surface area of the furnace is the predominant factor in increasing the efficiency of a furnace according to the present invention when compared to prior art devices.

Experimental results obtained in tests on protypes of a fireplace furnace according to the invention have borne out expectations based on the theory. By virtue of the heat transfer mechanisms employed, and the nature of the fireplace furnace, substantially large quantities of heat which not only would have been exhausted through, for example, the flue of the fireplace have been directed to the living quarters associated with the fireplace, In this instance, the work "substantially" is intended to mean a minimum of, for example, a 20% reduction in a fuel oil bill for the living quarters and random usage of the fireplace, and probably closer to a 25% reduction. The more the fireplace is used, the greater will be the fuel savings realized.

Further, the use of the fireplace furnace requires use of less wood and coal in the fireplace while obtaining much more usable heat. The invention raises the level of the base of the fuel burning portion of the fireplace, while, as mentioned above, still permitting the use of andirons and similar devices commonly used in fireplaces, but for those individuals having problems with smoke entering the room in which the fireplace is arranged, the raising of the base or fuel burning portion of the fireplace is a definite asset for it brings the bed of the fire closer to the flue of the fireplace where the draft is somewhat more effective.

Because the fire is actually built on the top wall of the fireplace furnace according to the invention, it is advisable to clean the top surface of the furnace at regular intervals, such as 24 hours, in order to prevent the buildup of ashes on the top wall of the furnace. Such ashes will, of course, act as an insulation and retard good heat transfer through the top wall of the furnace.

It will be understood that blower 26 is operably connected to a common household source of electric current, and the like, in a conventional manner such as by an electrical cord (not shown).

Although not shown in the drawings, it will be apparent that the inlet 20 and the outlet 22 may be reversed from the position shown in, for example, FIG. 1 of the drawings, without making any structural changes to the furnace. Further, the side walls 34,36, the front wall 24 and the back wall 38, as well as the bottom wall 32, cooperate with top wall 30 in such a manner that no smoke, ash, dust, and the like, from the burning of fuel above top wall 30 can enter into the heat chamber formed by the hollow housing 18.

While the various braces 56, 58 and 60 are basically structural members which may or may not be used as heat transfer members, with the same being true of the various walls of housing 18 and the concave surfaces 50, 52, and 54 of arcuate members 44, 46 and 48 which act as air directing veins, it will be appreciated that the draft potential of a furnace 10 according to the invention is more than adequate to provide combustion as well as provide heat transfer surface sufficient to restrict a mass exit of the heat from the bed of residue solid fuel (not shown) on top of housing 18.

Of course, if the various structural members are also constructed as heat transfer members, as is preferable, the resulting unit will be more economical for the consumer. In addition, heat transfer elements in the form of fins 62 further insure the maximum possible heat emission into the room or location in which the furnace is arranged, with braces 56, 58 and 60, as employed, being disposed for promoting peak value heat transfer. Note the transfer elements may be horizontal, vertical, or any combination thereof, as illustrated.

While arcuate members 44, 46 and 48 which form the air directing veins as shown as separate members mounted within housing 18, it will be readily understood that these members 44, 46, and 48 can be incorporated into the structure of housing 18 as part of the various walls of the housing 18. That is, the concave surfaces 50, 52 and 54 can be actually formed on the internal surfaces of the various walls which form housing 18. Further, it is possible to eliminate bottom wall 32 entirely, with the hearth 14 being used as the bottom of the furnace.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention. What is claimed as new is as follows:

1. A fireplace furnace, comprising, in combination:

a. a housing having a wall provided with an inlet and outlet, the inlet and outlet spaced from one another on the wall common to the inlet and outlet; and b. baffle means arranged within the housing for deflecting air flowing from the inlet to the outlet along a tortuous path within the housing, the baffle means including a pair of spaced, substantially parallel plates disposed extending into the housing from adjacent the inlet and outlet, the plates being spaced from one another and disposed between, the inlet and outlet, the housing walls including a top wall and a bottom area perpendicular to the wall common to the inlet and outlet with the plates extending from the bottom area to the top wall of the housing, and the baffle means further including a plurality of separate arcuate members disposed extending between the top wall and the bottom area of the housing, two of the arcuate members being arranged opposite of and opening concavely toward respective ones of the inlet and outlet of the housing, and another of the arcuate members being arranged between the plates of the baffle means, and between at least one of the arcuate members, and arranged opening concavely toward the plane of the two of the arcuate members.

2. A structure as defined in claim 1, wherein a brace is mounted within the housing, and a heat transfer fin is provided on the brace and spaced from the walls of the housing in order to increase the heat transfer efficiency of the housing, the brace being disposed for promoting peak value heat transfer.

3. A structure as defined in claim 1, wherein a plurality of longitudinal braces are mounted within the housing, one of the braces being arranged between a side wall of the housing associated with a respective one of the inlet and outlet, and a plate also associated with the respective one of the inlet and outlet, and other of the braces being disposed between the top wall and bottom area of the housing along the flow path formed by the arcuate members of the baffle means.

4. A structure as defined in claim 3, wherein at least one of the braces is provided with a heat transfer fin spaced from the walls of the housing in order to increase the heat transfer efficiency of the housing, the brace so provided with a fin being disposed for promoting peak value heat transfer.

5. A structure as defined in claim 4, wherein the housing is substantially rectangular with substantially planar walls, the inlet and outlet being provided in the walls and spaced transversely of a rectangular front wall of the foregoing.

6. A structure as defined in claim 5, wherein the top wall of the housing has undulations therein arranged transverse to the common wall of the housing for providing additional heat transfer surface for the housing and forming a grate for holding a fuel being burned.

7. A structure as defined in claim 6, further including a blower mounted in the inlet of the housing for forcing air along the flow path provided through the housing, the above in combination with a fireplace having an opening in which the housing and blower are disposed, with the top wall of the housing being arranged forming the grate of the fireplace.

8. A structure as defined in claim 1, wherein the housing is provided with a top wall having undulations formed therein transverse to the wall of the housing common to the inlet and outlet for providing additional heat transfer surface for the housing and forming a grate for holding a fuel being burned.

9. A structure as defined in claim 1, further including a blower mounted in the inlet of the housing for forcing air along the flow path provided through the housing, the above in combination with a fireplace having an opening in which the housing and blower are disposed, with the top wall of the housing being arranged forming the grate of the fireplace.

* * * * *